US009122290B2

(12) United States Patent
Eberlein

(10) Patent No.: US 9,122,290 B2
(45) Date of Patent: Sep. 1, 2015

(54) BANDGAP REFERENCE CIRCUIT

(71) Applicant: Intel Mobile Communications GmbH, Neubiberg (DE)

(72) Inventor: Matthias Eberlein, Holzkirchen (DE)

(73) Assignee: Intel Deutschland GmbH, Neubiberg (DE)

( * ) Notice: Subject to any disclaimer, the term of this patent is extended or adjusted under 35 U.S.C. 154(b) by 105 days.

(21) Appl. No.: 13/832,521

(22) Filed: Mar. 15, 2013

(65) Prior Publication Data

US 2014/0266139 A1 Sep. 18, 2014

(51) Int. Cl.
*G05F 3/16* (2006.01)

(52) U.S. Cl.
CPC ..... *G05F 3/16* (2013.01)

(58) Field of Classification Search
CPC ..... G05F 3/16
USPC ..... 323/313; 327/539, 542
See application file for complete search history.

(56) References Cited

U.S. PATENT DOCUMENTS 6,531,857 B2 3/2003 Ju
6,788,041 B2 9/2004 Gheorghe et al.
7,199,646 B1 * 4/2007 Zupcau et al. ..... 323/314
7,511,568 B2 * 3/2009 Kimura ..... 327/539
2008/0297130 A1 * 12/2008 Peng et al. ..... 323/313
2010/0188141 A1 * 7/2010 Aruga et al. ..... 327/539

OTHER PUBLICATIONS

G. Tzanateas, et al.; "A CMOS Bandgap Voltage Reference"; IEEE Journal of Solid-State Circuits, vol. SC-14, No. 3, Jun. 1979, p. 655-657.

Christian Jesus B. Fayomi, et al.; "Sub 1 V CMOS Bandgap Reference Design Techniques: a Survey"; Analog Integr Circ Sig Process; 2010; p. 141-157.

Hironori Banba, et al.; "A CMOS Bandgap Reference Circuit with Sub-1-V Operation"; IEEE Journal of Solid-State Circuits, vol. 34, No. 5, May 1999, p. 670-674.

* cited by examiner

*Primary Examiner* — Jue Zhang
(74) *Attorney, Agent, or Firm* — Eschweiler & Associates, LLC

(57) ABSTRACT

A circuit for generating a temperature-stabilized reference voltage on a semiconductor chip includes a differential amplifier having a first input, a second input and an output. The circuit further includes a CTAT circuit configured to generate a CTAT voltage at an output thereof. A first resistor is coupled between the output of the differential amplifier and the output of the CTAT circuit. Further, the first resistor is connected between the first input and the second input of the differential amplifier.

14 Claims, 2 Drawing Sheets

BANDGAP REFERENCE CIRCUIT

FIELD

This disclosure relates to a circuit for generating a temperature-stabilized reference voltage on a semiconductor chip. Circuits of this type are known in semiconductor circuit engineering as bandgap voltage reference (BVR) circuits.

BACKGROUND

Semiconductor BVR circuits are used to a great extent as voltage references for operating voltages in analog, digital and mixed analog-digital circuits. Conventional BVR circuits operate on the principle of the addition of two partial voltages with opposite temperature responses. While one partial voltage rises proportionately with the absolute temperature (PTAT partial voltage, also referred to as "proportional to absolute temperature"), the other partial voltage falls as the temperature rises (CTAT partial voltage, also referred to as "complementary to absolute temperature"). An output voltage with low sensitivity is obtained as the sum of these two partial voltages.

BVR circuits which are accurate and stable versus temperature, supply voltage and manufacturing variations are desirable. Further, BVR circuits are desired to be inexpensive and capable of allowing some load current connected to the output. Still further, in some applications BVR circuits are desired to provide low output reference voltages.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. Like reference numerals designate corresponding similar parts.

DETAILED DESCRIPTION

Figure 1:
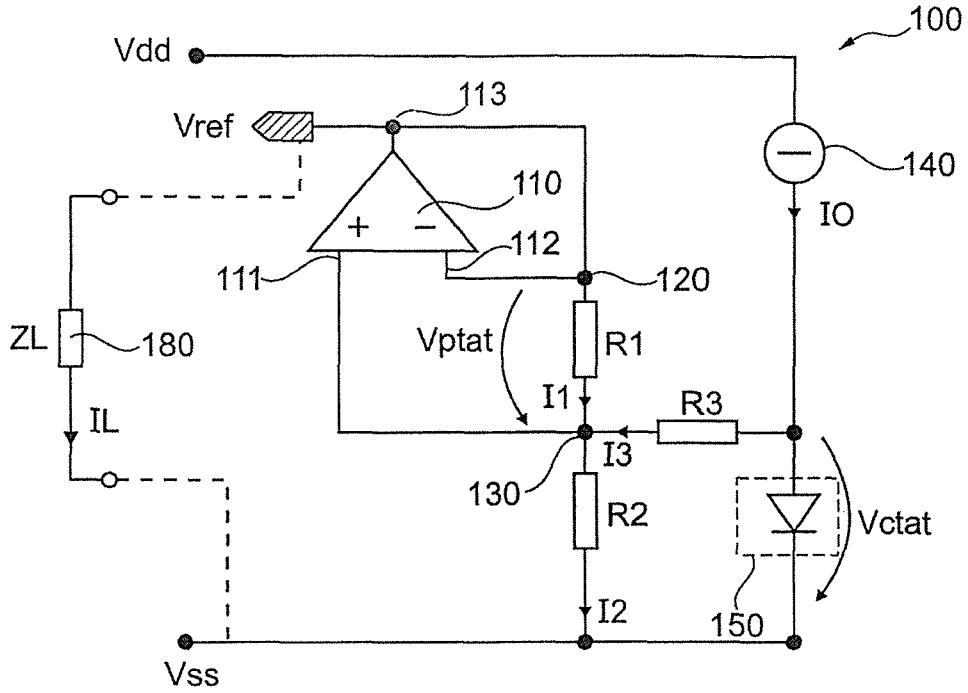
FIG. 1 is a simplified schematic diagram of an example bandgap voltage reference circuit.

In the following detailed description, reference is made to the accompanying drawings, which form a part thereof, and in which is shown by way of illustration specific embodiments in which the disclosure may be practiced. In this regard, directional terminology, such as "top", "bottom", "left", "right", "upper", "lower", etc., is used with reference to the orientation of the Figure(s) being described. Because components of the embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

It is to be understood that the features of the various example embodiments described herein may be combined with each other, unless specifically noted otherwise.

As employed in this specification, the terms "coupled" and/or "connected" are not meant to mean in general that elements must be directly coupled or connected together. Intervening elements may be provided between the "coupled" or "connected" elements. However, although not restricted to that meaning, the terms "coupled" and/or "connected" may also be understood to optionally disclose an implementation in which the elements are directly coupled or connected together without intervening elements provided between the "coupled" or "connected" elements. The disclosure of a direct coupling or connection may, in particular, be available if it is depicted by way of example in one or more of the example circuit diagrams shown in the figures.

Devices comprising a bandgap voltage reference (BVR) circuit are described herein. A BVR circuit is a circuit that provides a temperature and supply insensitive output voltage. BVR circuits are used to a great extent as voltage references for operating voltages in analog, digital and mixed analog-digital circuits. In particular they are used in integrated circuits (ICs) and memory devices. By way of example, BVR circuits may, e.g., be used in dynamic random access memories (DRAM), flash memories, power supply generation devices, DC bias voltage devices, current sources, analog-to-digital converters (ADCs), and digital-to-analog converters (DACs).

A BVR circuit, as described herein, may, e.g., provide an IC (Integrated Circuit) reference voltage. The reference voltage is, e.g., accurate and stable versus temperature, supply, and manufacturing variations. Further, the BVR circuit may be configured to work for supply voltages Vdd of, e.g., Vdd<=1.20V. In particular, BVR circuits configured to be operated by a supply voltage Vdd of less than e.g. 1.20V, 1.00V, 0.90V, 0.80V are considered herein.

Further, BVR circuits described herein may be configured to generate reference voltages Vref of, e.g., Vref<=1.20V. In particular, BVR circuits configured to generate reference voltages Vref of less than e.g. 1.20V, 1.00V (so-called sub1V BVR circuits), 0.90V, 0.80V are considered herein.

In this respect, it is to be noted that the expression "bandgap" as used in the term BVR does not imply that the output reference voltage Vref is near to the bandgap voltage of the semiconductor material, e.g. around 1.25V corresponding to the bandgap voltage of silicon. In contrast, as exemplified above, Vref may be significantly lower than the semiconductor material bandgap voltage.

Further, BVR circuits disclosed herein may be compatible with standard CMOS (Complementary Metal Oxide Semiconductor) processing. By way of example, MOSFETs (Metal-Oxide-Semiconductor Field-Effect Transistors) and PNP bipolar junction transistors (BJT) are available in standard CMOS processes. By way of example, special devices such as, e.g., lateral bipolar junction transistors (lateral BJTs) are not available in a standard CMOS processes. As the BVR circuits described herein may, e.g., be implemented without the use of any lateral BJT or any other devices not available in standard CMOS wafer processing, a standard CMOS process may, e.g., be used to manufacture BVR circuits described herein.

In conventional BVR circuits, an output reference voltage Vref is obtained based on a voltage that is proportional to absolute temperature (PTAT) and a voltage with negative temperature coefficient, which is complementary to absolute temperature (CTAT). As the temperature coefficients of these two voltages are opposite, a composition of the PTAT voltage and the CTAT voltage is insensitive to temperature variations.

Referring to FIG. 1, an exemplary BVR circuit 100 is illustrated. BVR circuit 100 is, e.g., suitable for fabrication within standard CMOS processes. BVR circuit 100 may comprise a differential amplifier 110 having a first, e.g., positive input 111 and a second, e.g., negative input 112. A first resistor R1 may be coupled between the first input 111 and the second input 112. Further, the differential amplifier 110 has an output 113 which may be coupled to a node 120. The node 120 may, e.g., be connected to an input, e.g., the negative input 112 of the differential amplifier 110.

The node 120 may also be connected to a terminal of the first resistor R1. A second terminal of the first resistor R1 may be connected to a common node 130.

A circuitry comprising, e.g., a second resistor R2 may be connected between the common node 130 and a negative supply voltage Vss, e.g. ground voltage. Thus, the first resistor R1 and the second resistor R2 may represent a first voltage divider connected in series between the output 113 of the differential amplifier 110 and negative supply voltage Vss.

Further, the BVR circuit 100 may comprise a first current source 140 generating an output current I0. The first current source 140 may have an input connected to a positive supply voltage Vdd. An output of the first current source 140 may be connected to an element 150 for generating a voltage Vctat, e.g. a forward biased p-n junction or a diode connected bipolar junction transistor where the base-emitter voltage Vbe may be used to generate the voltage Vctat.

Further, the output of the first current source 140 may be connected to the common node 130 via, e.g., a third resistor R3. Thus, e.g. a second voltage divider comprising, e.g., the third resistor R3 and the second resistor R2 may be provided in the BVR circuit 100. The second voltage divider R2, R3 is connected in parallel to the element 150 for generating a voltage Vctat. Further, the common node 130 may be located within the second voltage divider, e.g. between the third resistor R3 and the second resistor R2. The common node 130 may further be coupled to the positive input 111 of the differential amplifier. Stated differently, the second resistor R2 may be connected in parallel to a series connection of the element 150 for generating a voltage Vctat and the third resistor R3.

The differential amplifier 110 may be an asymmetric differential amplifier 110. In the following, the term asymmetric differential amplifier is used to mean that a differential pair of transistors (not shown in FIG. 1) of the differential amplifier 110 is operated at a current density ratio of 1:N, wherein N is a number unequal to 1.

Further, the output 113 of the differential amplifier 110 may, e.g., provide the output reference voltage Vref. That way, a low impedance output of the BVR circuit 100 is obtained. As will be described further below in conjunction with FIG. 4, other implementations to provide Vref are feasible.

Further, FIG. 1 illustrates, by way of example, a load circuitry 180. The load circuitry 180 may correspond to any circuitry such as, e.g., an IC, a memory device, etc. configured to be operated by the reference voltage Vref. The load circuitry 180 is represented in FIG. 1 by load resistor ZL. In a closed circuit condition, in which the load circuitry 180 is connected to Vref and, e.g., the negative supply voltage Vss, a load current IL flows from the reference voltage output 130 of the BVR circuit 110 to the negative supply voltage Vss.

In the following, the operation of the BVR circuit 100 is described. The temperature independent reference voltage Vref is generated by adding a PTAT current I1 and a CTAT current I3 into the second resistor R2 to result in a temperature independent current I2. In accordance with the disclosure, the PTAT current I1 is generated within the differential amplifier feedback loop comprising the differential amplifier output 113, the node 120, the second, e.g., negative differential amplifier input 112, the first, e.g., positive differential amplifier input 111, and the first resistor R1 connected between the first differential amplifier input 111 and the second differential amplifier input 112.

The CTAT current I3 flowing, e.g., through the third resistor R3 may be generated outside the feedback loop. The current summation of the PTAT current I1 and the CTAT current I3 may occur within the differential amplifier feedback loop, e.g. at common node 130 as depicted in FIG. 1. The total current I2 may, e.g., be the sum of the PTAT current I1 and the CTAT current I3. By adding the PTAT current I1 and the CTAT current I3, a temperature-independent output reference voltage Vref is generated.

More specifically, the voltage Vctat generated by the element 150 may be divided by the second voltage divider comprising the third resistor R3 and the second resistor R2. That way, depending on the resistance R3 of the third resistor R3 in comparison to the resistance R2 of the second resistor R2, the CTAT voltage used for generating Vref may only be a fraction of Vctat, namely the fraction which drops over the second resistor R2.

The PTAT voltage component of Vref appears as a voltage drop over the first resistor R1 (having a resistance R1) and is further multiplied by R2/R1 by virtue of the first voltage divider comprising the first resistor R1 and the second resistor R2. Due to its asymmetric nature, the (asymmetric) differential amplifier 110 has an intentional PTAT "offset voltage", which is connected with both amplifier inputs 111, 112 to the first resistor R1. Thus, the differential amplifier 110 may drive the current through the first voltage divider (resistor string R1, R2) in a feedback loop operation to such value that the respective voltage Vptat is created between its positive and negative inputs 111, 112, respectively.

In general, the element 150 and the second voltage divider (i.e. the third resistor R3 and the second resistor R2) are merely a specific example of a CTAT circuit configured to generate a (e.g. fractional) CTAT voltage which is added to the voltage Vptat dropping over the first resistor R1 located in the feedback loop to derive the output reference voltage Vref. The connection between the second resistor R2 and third resistor R3, e.g. the common node 130, may be viewed as the output of this CTAT circuit. Thus, the CTAT voltage at the output of the CTAT circuit and the voltage Vptat may sum up to the output reference voltage Vref. It is to be noted that the CTAT circuit generating the CTAT voltage at, e.g., the common node 130 may be implemented by other circuitry than shown, in particular without using a (second) voltage divider. However, more specifically, the common node 130 may, optionally, serve as a connection node of the first voltage divider (R1, R2) and the second voltage divider (R3, R2), in particular when the second resistor R2 is used as a resistor common to these two voltage dividers. Then, the current I2 flowing through the second resistor R2 has both a CTAT and a PTAT component, however, with predominant CTAT component. This predominant CTAT component translates into a predominant CTAT behavior of the voltage dropping over the second resistor R2, which is then compensated by adding Vptat to yield the temperature-stabilized output reference voltage Vref.

Further, it is to be noted that the first current source 140 generating the output current I0 and/or the second resistor R2 may be removed. In this case, the resistance values R1, R3 for the first and third resistors R1 and R3, respectively, are less flexible to achieve temperature compensation, and the output reference voltage Vref is always greater than Vctat (or Vbe), because no CTAT voltage being a fraction of Vctat (or Vbe) is generated.

Further, it is to be noted that the Vptat voltage may be tapped at another tapping point from the resistor string R1, R2 (i.e. the first voltage divider) than at the output of the CTAT circuit (note that in FIG. 1 the output of the CTAT circuit for generating the (e.g. fractional) CTAT voltage and the tapping of the Vptat voltage is both performed, by way of example, at the common node 130). That is, the first and second inputs 111, 112 of the differential amplifier 110 may be connected to other points within the first voltage divider of resistors R1, R2 to achieve a specific value and, e.g., curvature of the output reference voltage Vref.

As will be explained in more detail with reference to FIGS. 2 and 3, the differential amplifier 110 may, e.g., comprise a differential pair of input MOSFET transistors M5, M6 (see FIG. 2) or, e.g., a differential pair of bipolar junction transistors (BJs), M5', M6' (see FIG. 3). In both cases, the differential pair of transistors is operated with an asymmetric current density of ratio 1:N. If the differential pair of transistors is composed of MOSFETs M5, M6, these MOS transistors are operated in weak inversion (i.e. are biased in the sub-threshold region) to have an exponential characteristic equal to bipolar junction transistors.

Thus, if the asymmetric differential pair is composed of MOS transistors operated in weak inversion, the equilibrium state of the feedback loop generates a stable gate-source voltage difference which strictly follows the law $$Vptat = \eta \cdot \frac{k \cdot T}{q} \cdot \ln(N) \tag{1}$$

where k denotes the Boltzmann's constant, q denotes the electron charge, T denotes the absolute temperature, and η denotes the sub-threshold slope factor. In the case of a bipolar junction transistor input pair, the sub-threshold slope factor η may be substituted by 1 in equation (1), and Vptat is a stable base-emitter voltage difference of the bipolar junction transistor input pair in the equilibrium feedback loop state.

Given the reference voltage Vref is tapped at the output of the differential amplifier 110 as is, by way of example, depicted in FIG. 1, Vref is given by:

$$Vref = Vptat + \frac{R2}{R2 + R3} \cdot \left(Vptat \cdot \frac{R3}{R1} + Vbe\right). \tag{2}$$

According to equation (2) the output reference voltage Vref can be adjusted by resistor values R1, R2 and R3 to achieve values smaller than the silicon bandgap voltage (around 1.25V) and to achieve zero temperature coefficient. Therefore, this technique is capable of generating very low output reference voltages Vref. In particular, as for R3 unequal to zero, only a fraction of the voltage Vctat may be used as CTAT voltage for creating a "fractional bandgap" output Vref, sub-1V BVR circuits for reference voltages Vref of equal to or less than 1.00V, 0.90V, 0.80V, etc. are feasible.

Figure 2:
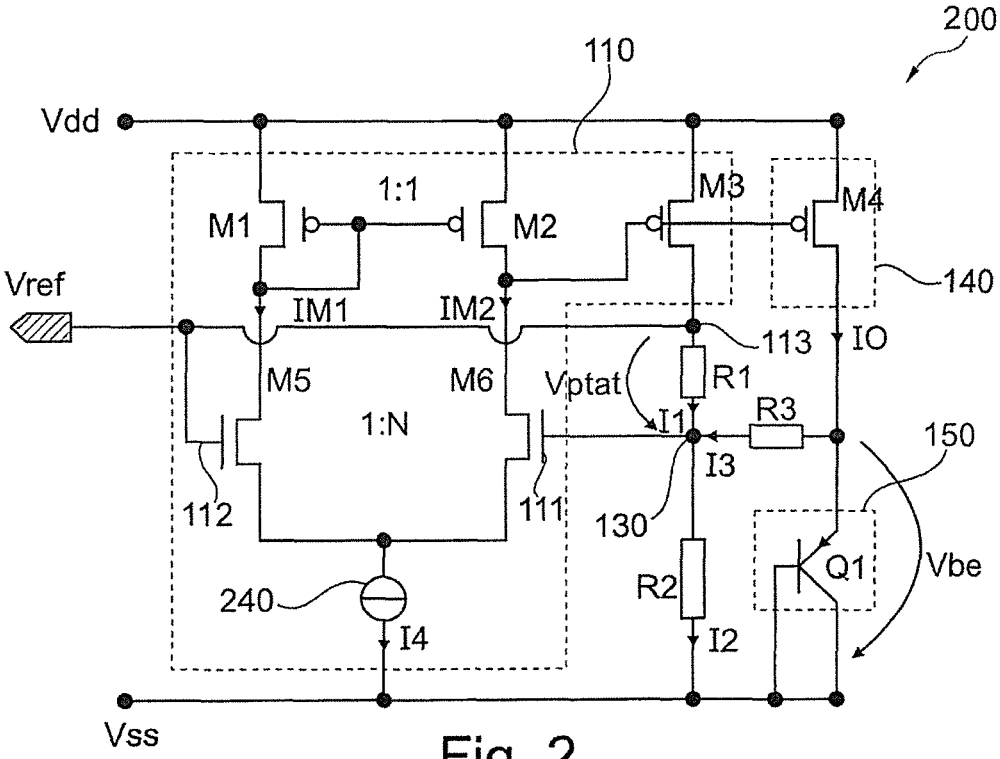
FIG. 2 is a schematic diagram of an example bandgap voltage reference circuit in accordance with the implementation shown in FIG. 1.

FIG. 2 illustrates an example BVR circuit 200. BVR circuit 200 may be a specific implementation of the BVR circuit 100, and reference is made to the previous description in order to avoid reiteration.

In FIG. 2 a specific, example implementation of the differential amplifier 110 is shown. Further, a specific, example implementation of the first current source 140 and a specific, example implementation of the element 150 for generating a voltage Vctat are shown. It is to be noted that these specific implementations must not necessarily be combined with each other.

In FIG. 2 the differential amplifier 110 uses a first MOSFET M5 and a second MOSFET M6 as the asymmetric input differential pair. The MOS transistors M5, M6 may, e.g., be NMOS transistors. The drain of MOS transistor M6 may form the first, e.g., positive input 111 of the differential amplifier 110 and may be connected to the common node 130. The drain of MOS transistor M5 may form the second, e.g., negative input 112 of the differential amplifier 110 and may be connected to the output 113 thereof. Further, as explained in conjunction with FIG. 1, the output reference voltage Vref may, optionally, be connected to the output 113 of the differential amplifier 110.

The differential amplifier 110 may further comprise a current mirror comprising the transistors M1 and M2. Transistors M1 and M2 may be MOSFETs, e.g., PMOS transistors as depicted in FIG. 2. The current mirror M1, M2 may provide a defined ratio of currents IM1:IM2 to flow through the transistors M5 and M6 of the input differential pair. The sources of the MOS transistors M5 and M6 may be tied together and a current I4 may add up from the source currents to be the sum of the currents IM1 and IM2. By way of example, if the current mirror M1, M2 is a 1:1 current mirror, i.e. IM1=IM2, the drain-source current of the first MOS transistor M5 and the drain-source current of the second MOS transistor M6 are equal, i.e. I4:2.

I4 may be set by a second current source 240, which may, e.g., form part of the differential amplifier 110. The second current source 240 may set I4 to a value such that the MOSFETs M5 and M6 are operated in weak inversion (i.e. in the sub-threshold region).

It is to be noted that operating the MOS transistors M5 and M6 in weak inversion depends both on the W/L ratio (channel ratio) of each MOS transistor M5, M6 and on the current IM1 and IM2 flowing through each MOS transistor M5, M6, respectively. More specifically, an operation in weak inversion is established in each of the MOS transistors M5, M6 if the corresponding W/L ratio is sufficiently great and/or the current IM1 (or IM2) is sufficiently small.

As already mentioned, the input differential pair M5, M6 is configured to operate at different current densities with a current density ratio of 1:N. There are various possibilities to implement different current densities in the input differential pair M5 and M6. According to one possibility, the ratio 1:N of the current densities may be implemented by specifically sizing the MOS transistors M5 and M6. By way of example, assuming e.g. IM1=IM2, the W/L ratio of M6 may be N-times larger than the W/L ratio of M5. According to another possibility, a current density ratio of 1:N may be established by forcing currents IM1, IM2 of current ratio IM1:IM2 equal to 1:N through equally-sized MOS transistors M5, M6, i.e. MOS transistors M5, M6 having equal W/L ratios. It is also possible to combine these two approaches, i.e. to provide for a specific, unequal sizing of MOS transistors M5 and M6 and to provide for a current ratio IM1:IM2 different to 1 to obtain the desired current density ratio of 1:N.

An asymmetric MOS differential pair driven in weak inversion generates the required PTAT offset-voltage Vptat between the input terminals 111, 112 in feedback loop equilibrium state.

The differential amplifier 110 may further include a second amplifier stage comprising MOS transistor M3. By way of example, MOS transistor M3 is a PMOS transistor. The MOS transistor M3 may directly feed into the first resistive dividers R1, R2. Further, the MOS transistor M3 may provide the output 113 of the differential amplifier 110.

The element 150 for generating a voltage Vctat may, e.g., be implemented by a bipolar junction transistor Q1. The bipolar junction transistor Q1 may, e.g., be a parasitic (substrate) PNP transistor available in all CMOS technologies.

By way of example, the current flowing through the second amplifier stage (e.g. transistor M3) may be mirrored to the first current source 140 for generating the current I0. More specifically, a MOS transistor M4, e.g. a PMOS transistor, may be used for the generation of the current I0 in the first current source 140 and having its gate coupled to the gate of MOS transistor M3. Depending on the load ZL at Vref the current through the second amplifier stage (e.g. transistor M3) is well-known and may have PTAT behavior. However, the value of the current flowing through the load circuitry 180 is not critical for a proper operation of the BVR circuit 200 due to the insensitivity of Vctat (or Vbe) on this current. Further, for the same reason, the matching of MOS transistors M3 and M4 is less important.

Further, the second current source 240 generating the current I4 is uncritical in one embodiment. By way of example, the second current source 240 may be implemented as a replica of the first current source 140 by means of current mirroring.

It is to be noted that the implementation shown in FIG. 2 may provide another advantage: It may use an optimal biased MOS input differential pair M5, M6 without the need for level shifting. That is, the voltage level at common node 130 together with the output reference voltage Vref may be adjusted to fit with the threshold voltages of the input differential pair M5, M6.

The differential amplifier 110 may have an input differential pair of PMOS transistors M5, M6 rather than NMOS transistors M5, M6 as exemplified in FIG. 2. Further, other differential amplifier structures such as, e.g., folded cascode type amplifiers, two stage amplifiers etc, are possible.

Figure 3:
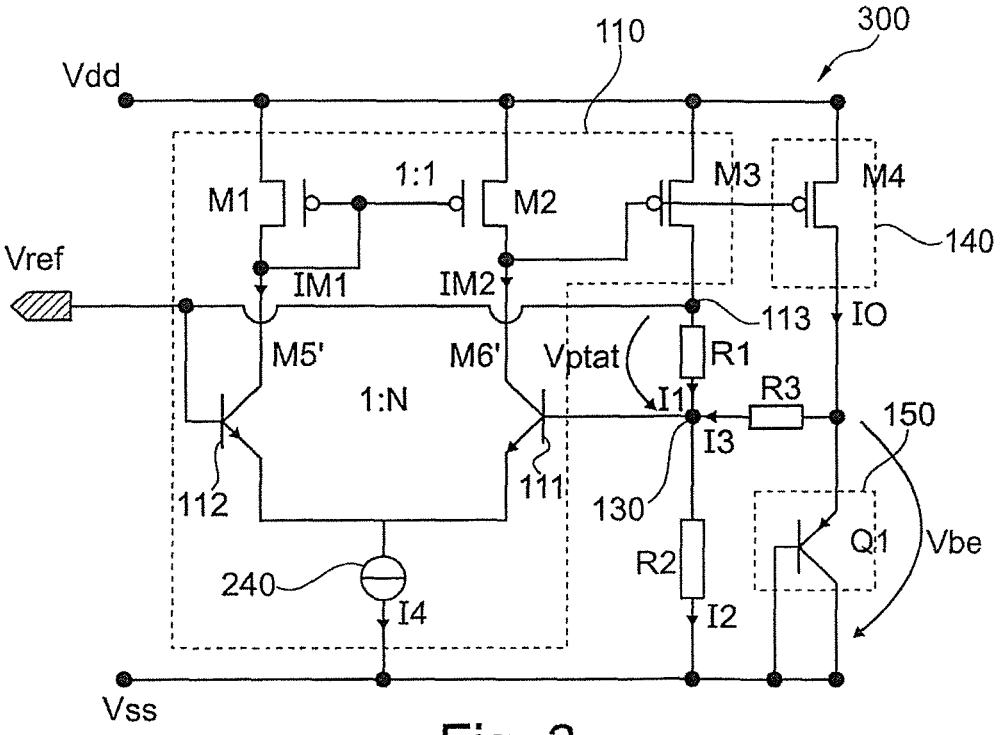
FIG. 3 is a schematic diagram of an example bandgap voltage reference circuit in accordance with the implementation shown in FIG. 1.

FIG. 3 illustrates, by way of example, an exemplary BVR circuit 300, which is another possible implementation of the BVR circuit 100, and reference is made to the previous description in order to avoid reiteration. More specifically, the BVR circuit 300 may be identical to the BVR circuit 200 except that the asymmetric input differential MOS pair is replaced by an asymmetric input differential pair of bipolar junction transistors M5', M6'. As these transistors always generate a stable base-emitter voltage difference at their inputs 111, 112 in the equilibrium state of feedback operation, no specific requirements for driving the input bipolar transistor pair M5', M6' have to be met. Similar to the explanations above, a current density ratio of 1:N may be established, wherein the current density ratio may either be reduced by setting the current mirrors M1, M2 to different currents IM1, IM2 and/or by differently sizing the bipolar transistors M5', M6.

Figure 4:
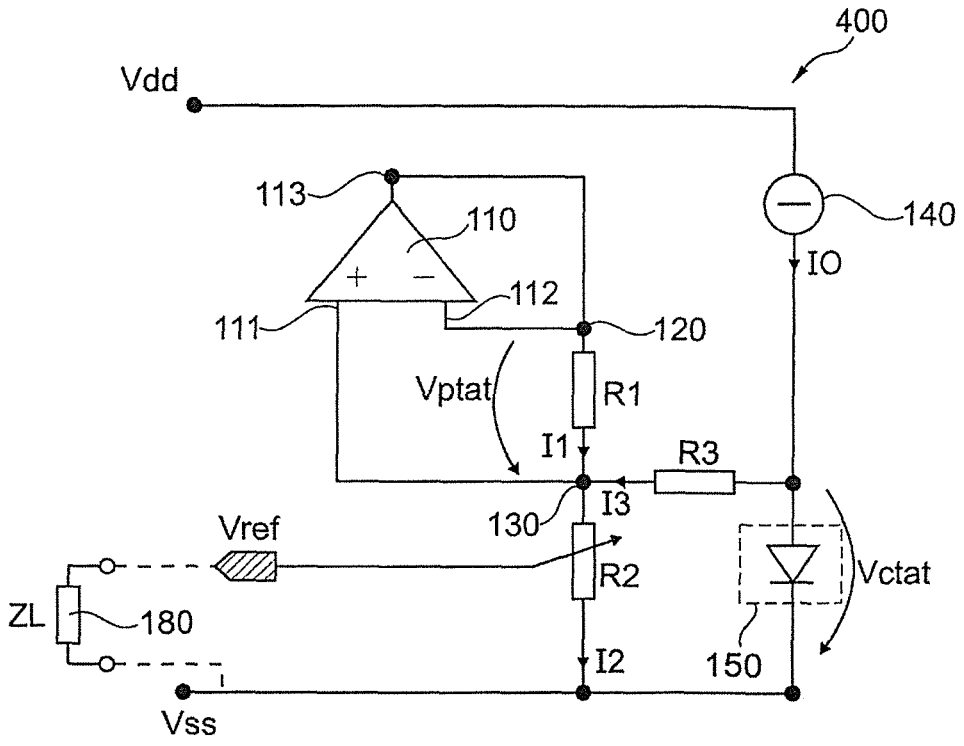
FIG. 4 is a simplified schematic diagram of an example bandgap voltage reference circuit.

Referring to FIG. 4, a simplified schematic diagram of an exemplary BVR circuit 400 is shown. The BVR circuit 400 may be identical to the BVR circuit 100 except that the reference voltage Vref is tapped at a node inside the resistor string comprising, e.g., the resistors R1 and R2 rather than at the output 113 of the differential amplifier 110. That is, the reference voltage Vref may be tapped at a node inside the first resistive divider.

By way of example, the node where the output reference voltage Vref is tapped may be located within the second resistor R2. In this case, the second resistor R2 may be implemented by two resistors connected in series and having a total resistance R2.

By tapping the output reference voltage Vref within the resistor string comprising resistors R1, R2, the voltage level of Vref may be reduced to any desired value. By way of example, a temperature compensated reference voltage output Vref with levels smaller than 0.9V, 0.8V, 0.7V, 0.6V, etc. may be obtained. However, output impedances as low as the impedances which can be obtained when tapping Vref at the output 113 of the differential amplifier 110 may not be achieved that way.

All implementations disclosed herein may provide for high power supply rejection. As the output voltage reference is generated inside a feedback loop, any external distortion is attenuated by the loop gain.

Further, low output impedances may be achieved. As the output voltage reference Vref is tapped inside the feedback loop, Vref is not or only little degraded by load currents.

Output noise may be low. Again, the feedback loop effectively suppresses the circuit noise appearing at the output.

Only a small number of resistors is needed. Thus, high accuracy due to less mismatch sources can be obtained. Further, only a small semiconductor area is needed.

The BVR circuits described herein may provide high flexibility for voltage levels. The internal levels (Vref, voltage at the common node 130) may be adjusted for specific supply or amplifier common-mode range without loss of performance.

The BVR circuits described herein may provide high design simplicity. As a consequence, small area demand, low power consumption and less sources of error may be obtained.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A circuit for generating a temperature-stabilized reference voltage on a semiconductor chip, comprising:

a differential amplifier comprising a first input, a second input and an output;

a complementary to absolute temperature (CTAT) circuit configured to generate a CTAT voltage at an output thereof; and a first resistor comprising a first terminal and a second terminal, wherein the first resistor is coupled between the output of the differential amplifier and the output of the CTAT circuit, and wherein the first terminal of the first resistor is connected to the first input of the differential amplifier, and the second terminal of the first resistor is connected to the second input of the differential amplifier and to the output of the differential amplifier;

wherein the CTAT circuit comprises a second resistor coupled between the output of the CTAT circuit and a negative supply voltage;

wherein the CTAT circuit further comprises a bipolar junction transistor and a third resistor, and wherein the second resistor is connected in parallel to a series connection of the bipolar junction transistor and the third resistor;

wherein the first resistor, the second resistor and the third resistor are connected to a common node.

2. The circuit of claim 1, wherein the differential amplifier comprises an input differential pair comprising a first transistor and a second transistor.

3. The circuit of claim 2, wherein the differential amplifier is configured such that a current density flowing through the first transistor is different than a current density flowing through the second transistor.

4. The circuit of claim 2, wherein the first transistor and the second transistor are MOS transistors or bipolar junction transistors.

5. The circuit of claim 4, wherein the first transistor and the second transistor are operated in weak inversion.

6. The circuit of claim 1, wherein a reference voltage output of the circuit is connected to the output of the differential amplifier.

7. The circuit of claim 1, wherein a reference voltage output of the circuit is tapped across the second resistor.

8. The circuit of claim 1, wherein the first resistor is directly connected between the first input and the second input of the differential amplifier.

9. The circuit of claim 1, wherein the first resistor is directly connected between the output of the differential amplifier and the output of the CTAT circuit.

10. A circuit for generating a temperature-stabilized reference voltage on a semiconductor chip, comprising:

a differential amplifier comprising a first input, a second input and an output; a feedback circuitry configured to couple the output of the differential amplifier back to at least one of the first input and the second input thereof; and a first resistor comprising a first terminal and a second terminal, wherein the first resistor is coupled between the output of the differential amplifier and the output of the CTAT circuit, and wherein the first terminal of the first resistor is connected to the first input of the differential amplifier, and the second terminal of the first resistor is connected to the second input of the differential amplifier and to the output of the differential amplifier;

a second resistor coupled between the first resistor and a negative supply voltage;

a bipolar junction transistor which is connected in parallel to a series connection of a third resistor and the second resistor;

wherein the first resistor, the second resistor and the third resistor are connected to a common node.

11. The circuit of claim 10, wherein a reference voltage output of the circuit is connected to an output of the differential amplifier.

12. The circuit of claim 10, wherein a reference voltage output of the circuit is tapped across a resistor string comprising the first resistor and the second resistor.

13. The circuit of claim 10, wherein the first resistor is directly connected between the first input and the second input of the differential amplifier.

14. The circuit of claim 10, wherein the first resistor is directly connected between the output of the differential amplifier and the output of the CTAT circuit.

* * * * *